United States Patent [19]

Nahon

[11] 4,400,027

[45] Aug. 23, 1983

[54] RECESSED WINDOW LOCK

[76] Inventor: Abraham S. Nahon, 1026 Arboretum Rd., Wyncote, Pa. 19095

[21] Appl. No.: 230,888

[22] Filed: Feb. 2, 1981

[51] Int. Cl.[3] ..... E05C 19/18

[52] U.S. Cl. ..... 292/288; 292/DIG. 47

[58] Field of Search ..... 29/700, 235, 255, 278, 29/280, 281; 70/371, 90; 292/288, 155, 144, DIG. 47

[56] References Cited

U.S. PATENT DOCUMENTS

| | | | |
|---|---|---|---|
| 420,298 | 1/1890 | Minder | 292/155 |
| 1,461,554 | 7/1923 | Raffay | 29/280 |
| 3,019,521 | 2/1962 | Clark | 29/278 |
| 4,068,506 | 1/1978 | Phelps | 292/288 |

OTHER PUBLICATIONS

"Window Locks" appearing on pp. 140, 141 of Mar., 1979 Edition of Consumer Reports.

*Primary Examiner*—Richard E. Moore
*Attorney, Agent, or Firm*—Karl L. Spivak

[57] ABSTRACT

The window lock includes in combination a cylindrical barrel suitable for recessed installation and a special key for insertion and removal of the barrel from a window sash. The cylindrical barrel is fabricated of suitable length to seat within a bore drilled entirely through the lower sash and a portion of the upper sash of a double hung type window. The bore is drilled of sufficient depth to recess entirely the barrel so that there are no interiorly projecting or otherwise exposed parts. The barrel is interiorly formed with a recessed socket and the special key is provided to engage the socket for barrel removal purposes when it is desired to open the window.

5 Claims, 6 Drawing Figures

RECESSED WINDOW LOCK

BACKGROUND OF THE INVENTION

The present invention relates generally to the field of locking devices for windows, and more particularly, is directed to a recessed type of lock suitable for use with double hung windows.

The double hung type of window installation has been commonly employed for many years both for use in and about residential constructions and also for commercial and industrial buildings. The double hung window constructions have usually been provided with some type of a lock which interacts between the upper rail of the lower sash and the lower rail of the upper sash to secure the upper and lower sash together in a manner to discourage entry into the interior of the building through the window opening. For this purpose, many types of locks have been utilized, for example, the common cam type sash lock, wedge type ventilating lock, key operated cam latches, key operated pin type locks, friction type securing devices and other more or less complicated structures. All of these devices are commonly secured to the sash by the use of wood screws of sheet metal screws and all suffer from the common problems that the screws can be rather easily worked out of the sash by a determined intruder who need utilize only rather basic easily available, prying type of tools.

In an effort to improve over the screw connected locking devices, other workers in the art have employed nails or other elongate members which insert through pre-drilled openings provided in overlapping portions of the sash members. These nail type locking devices all suffer from a common problem in that portions of the elongate locking members project interiorly from the lower sash. Accordingly they are easily removed from within the building by simply grasping and pulling the member from its associated opening. Under these circumstances all a would-be thief need do to defeat the purpose of a nail type locking device is to break the glass, reach interiorly, and then simply pull the elongate member from its associated opening, thereby freeing the lower sash for easy opening.

SUMMARY OF THE INVENTION

The present invention relates generally to the field of window locks, and more particularly, is directed to a recessed lock that is inaccessible either from the interior or exterior of the building in the absence of a specially designed key therefor.

The present invention includes a barrel type locking device that is insertable into a bore that can be easily drilled through overlapping portions of the lower sash and the upper sash of a double hung type window. The barrel is shorter in length than the combined length of the bore to thereby recess the barrel completely into the bore without presenting any projecting construction components that are easily accessible, either from the exterior or from the interior of the building. The barrel includes an interiorly open recess or lock means which is designed for operation only with a special key for easily inserting or removing the barrel from its associated sash opening.

A specially designed key cooperates with the recess in the barrel in a manner to facilitate removing the barrel lock from its cooperating bore when it is desired to open the window for any legitimate purpose. It is to be noted that the barrel remains recessed within the construction of the lower sash under all conditions of locked use, thereby to discourage tampering or removal by any tool other than the specially designed key.

Preferably, the barrel lock is provided of strong, rigid material, such as steel of suitable diameter to resist bending or shearing. By providing an entirely recessed configuration, the barrel lock of the present invention offers greater security than is presently available with any prior art pin type locking device. The barrel lock after installation is practically invisible and cannot be picked or otherwise tampered with. The barrel lock is practically jimmy proof once it is properly placed in the sash, but it can be readily opened by applying the special key within the recessed locking means. The device is easy to install and can be arranged to permit ventilation without sacrificing security.

It is another object of the present invention to provide a novel recessed window lock that is designed to seat entirely within a cylindrical bore provided through cooperating sash in a manner to offer no exterior components that can be grasped or otherwise worked to remove the lock from the window sash.

It is another object of the present invention to provide a novel recessed window lock suitable for use with double hung windows and which can be removed from the window sash only by use of a specially designed key when inserted within a cooperating locking means.

It is another object of the present invention to provide a novel recessed window lock that is simple to install and is practically invisible when in use.

It is another object of the present invention to provide a novel recessed window lock that is simple in construction, inexpensive in manufacture and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
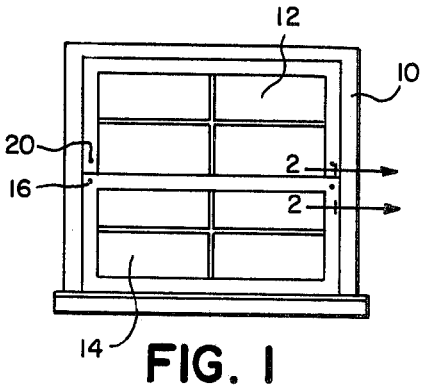
FIG. 1 is a front elevational view of a double hung window sash construction equipped with the recessed lock of the present invention.

Although specific terms are used in the following description for the sake of clarity, these terms are intended to refer only to the particular structure of the invention selected for illustration in the drawings and are not intended to define or limit the scope of the invention.

Figure 2:
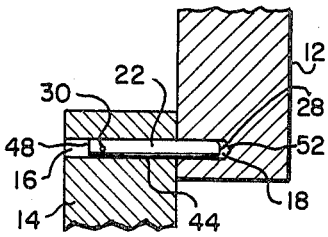
FIG. 2 is an enlarged, cross sectional view taken along line 2—2 on FIG. 1, looking in the direction of the arrows.
Figure 3:
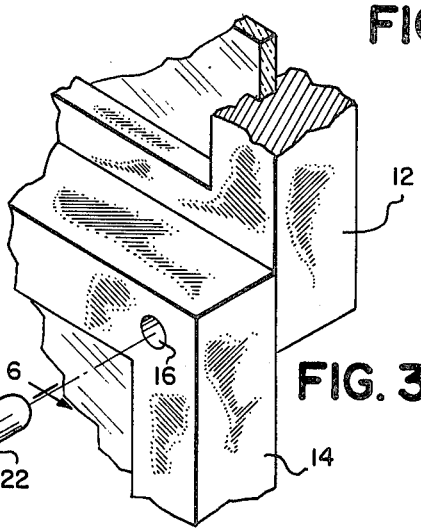
FIG. 3 is an enlarged, perspective view showing the lock of FIG. 2 in exploded relationship.

Referring now to the drawings, there is illustrated in FIG. 1 a conventional window construction of the double hung type which includes an interior window frame 10, and an upper sash 12 and a lower sash 14 of conventional construction which are arranged for vertical movement relative to the frame. As best seen in FIGS. 1 and 2, either or both of the right and left vertical rail members of the upper and lower sash 12, 14 are drilled or otherwise treated to provide a generally horizontally positioned bore 44 which comprises the axially aligned openings 16, 18. The lower sash elongated opening 16 extends entirely through the upper rail of the lower sash member 14 and the upper sash opening 18 extends only partially through the lower rail of the upper sash member 12 to thereby provide an inwardly open and an outwardly closed end to the bore 44 formed by the aligned openings 16, 18.

Figure 6:
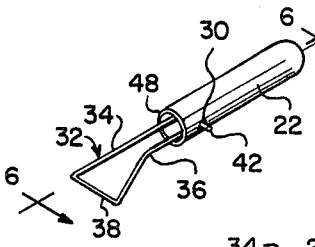
FIG. 6 is an enlarged, cross sectional view taken along line 6—6 on FIG. 3.
Figure 6:
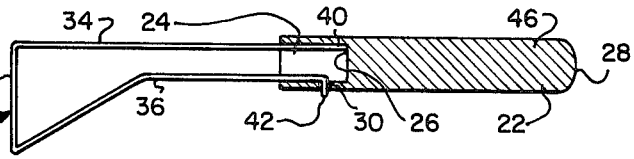
Figure 4:
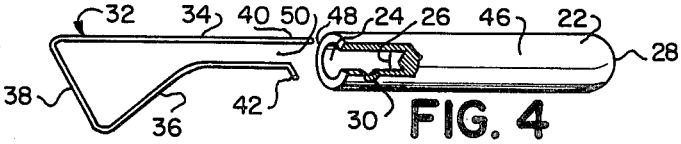
FIG. 4 is an enlarged, perspective, exploded view of the window lock and key therefor, partly broken away to explore interior construction details.
Figure 5:
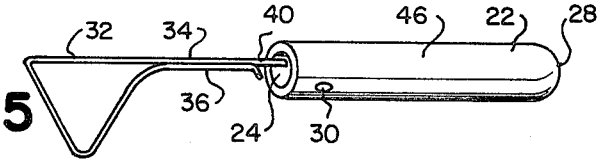
FIG. 5 is an view similar to FIG. 4 showing the key in squeezed position prior to being inserted into the barrel recessed locking means.

As illustrated in FIGS. 4–6 the recessed window lock comprises generally a cylindrical barrel 22 of size suitable to slide into and out of the drilled sash bore 44 without extensive friction. Preferably, the barrel 22 is fabricated of a strong material, such as steel, which may be plated with a suitable bright metal, for example nickel or chromium, to provide a decorative finish. The barrel 22 is preferably formed with a solid body 46 which terminates at its outward, inserted end in a rounded nose 28. The barrel 22 is drilled or otherwise formed at its interiorly facing end 48 with a locking means comprising a socket or recess 24. The recess 24 terminates interiorly in a flat bottom 26, which bottom acts as a stop for positioning the key 32 as hereinafter more fully set forth. A transversely drilled or otherwise formed key tooth opening 30 communicates with the recess 24 above the recess bottom 26, as best seen in FIGS. 4 and 6.

A bent wire key 32 is provided for simply insertion and withdrawal of the barrel 22 into and out of the bore 44 and preferably is formed of hard drawn spring steel wire, sixteen gauge, with tin, nickel or other bright decorative finish. The key 32 is bent to form a generally transverse web 38 and integral parallel legs 34, 36 extending therefrom. The leg 34 is preferably straight and extends at approximately ninety degrees from the web 38. The straight leg 34 terminates inwardly in an extended positioning finger 40, the use of which will hereinafter be more fully set forth. The second leg 36 integrally extends from the web 38 and normally defines a space or opening 50 with the straight leg 34. The natural spring of the material forming the key 32 functions to normally maintain the distance 50 between the key legs 34, 36 at all times. The bent leg 36 terminates at its remote end in a bent tooth 42 which tooth is positioned somewhat closer to the web 38 than is the end of the positioning finger 40.

It will be appreciated that other interlocking arrangements between a key 32 and a barrel locking means can be provided and still fall within the spirit and scope of this invention. For example, the barrel recess could be threaded and the key could be provided with cooperating threads. Alternately, magnetically interconnecting, frictionally interconnecting, or other releasably connecting components could be designed. It is the recessed position of the barrel within the sash that renders the device relatively tamper proof, and not the particular arrangement of the locking means and key.

As best seen in FIGS. 5 and 6, the key 32 can readily be positioned within the barrel recessed locking means 24 by squeezing the legs 34, 36 together to close the opening 50 therebetween. See FIG. 5. In this configuration, the key 32 can be easily inserted into the recess 24 until the positioning finger 40 bottoms against the flat bottom 26 of the recess 24. See FIG. 6. With the positioning finger 40 applied against the recess bottom 26, the bent tooth 42 of the key 32 will then be precisely longitudinally aligned to engage within the transverse key opening 30 provided in the barrel body.

When the key 32 is rotated with respect to the locking means 24 to align the key tooth 42 with the bore opening 30, the tooth 42 will freely enter the opening 30 under bias of the memory of the spring material forming the key 32 to thereby engage the key 32 with the barrel 22. When the tooth 42 is engaged within the opening 30, the barrel can be either pushed into the bore 44 or pulled from the bore 44 by applying either inwardly or outwardly directed forces upon the key 32. In order to remove the key 32 from association with the barrel 22, the legs 34, 36 can simply be squeezed together to again eliminate the opening 50 therebetween to thus free the key tooth 42 from the transverse recess opening 30. With legs squeezed together as in FIG. 5, the key can be withdrawn interiorly through the locking means 24 out of engagement with the barrel 22.

In order to use the barrel lock 22 of the present invention, a conventional hand drill (not shown) can be employed to drill a generally horizontal bore 44 by providing the aligned openings 16, 18 respectively in the lower and upper sash 14, 12, as best seen in FIG. 2. The legs 34, 36 of the key 32 are then squeezed to the position of FIG. 5 and inserted into the recess 24 of the barrel 22 in the manner illustrated in FIG. 6 until the positioning finger 40 of the key straight leg 34 bears against the bottom 26 of the barrel recess 24. Then, by grasping the web 38, the key 32 can be rotated relative to the barrel 22 until the key tooth 42 aligns with and enters the key opening 30 provided through the barrel sidewall above the bottom 26 of the recess 24. The natural spring of the material bent to form the key will cause the tooth 42 to enter the opening 30 and thereby releasably lock the key 32 with the barrel 22. It is noteworthy that the positioning finger 40 facilitates the interlocking between the key tooth 42 and the transverse opening 30 in a foolproof manner by feel alone, without requiring visual operation. A simple rotation of the key 32 relative to the barrel 22 with the finger 40 touching the recess bottom 26 will assure that the tooth 42 engages within the key opening 30 under impetus of the spring memory of the key legs 34, 36.

With the key 32 engaged with the barrel 22 at the cooperating interaction of the tooth 42 within the opening 30, the barrel 22 can be seated within the bore 44 by simply pushing the key 32 (and the connected barrel) inwardly until the barrel rounded nose 28 engages the bottom 52 of the upper sash opening 18. See FIG. 2. In this position, it is noteworthy that the interior end 48 of the barrel 22 is recessed within the lower sash opening 16 whereby it is completely inaccessible to manual grasping or removal by usually available hand tools. Thus, a would-be burglar would have great difficulty in removing the barrel 22 from the bore 44 without having special tools adapted for this purpose. However, a home owner can readily function the device by simply employing the key 32 in its designed manner.

If desired, one or more additional, alternate openings 20 in vertical alignment with the opening 18 may be provided in the upper sash 12 in order to lock the lower sash 14 in one or more open, ventilating positions. All that would be required would be to align the bottom sash opening 16 with an alternate upper sash opening 20, to thereby provide an aligned bore at a different elevation for receipt of the locking barrel 22 therewithin.

Although the present invention has been described with reference to the particular embodiment herein set forth, it is understood that the present disclosure has been made only by way of example and that numerous changes in the details of construction may be resorted to without departing from the spirit and scope of the invention. Thus, the scope of the invention should not be limited by the foregoing specification but rather only by the scope of the claims appended hereto.

What is claimed is:

1. In a locking device adapted to seat within openings provided in a window construction, the combination of a barrel having a locking means at one end thereof, the locking means comprising an end recess in the barrel, the recess being defined by cylindrical sidewalls and a generally flat bottom, and an opening through the sidewall in communication with the recess, the barrel being positioned to be recessed entirely into the window construction; and a key adapted for releasable engagement with the locking means to alternately engage and disengage the barrel, the key comprising a first leg and a second leg, the second leg comprising a bent tooth, the tooth being adapted to be removably inserted into the opening, and the first leg being longer than the second leg, and the first leg terminating endwardly in a positioning finger, the positioning finger being adapted to contact the recess bottom; whereby the barrel may be removably inserted into a portion of the window construction.

2. The locking device of claim 1 wherein the length of the first leg exceeds the length of the second leg by a distance equal to the distance from the recess bottom to the opening.

3. The locking device of claim 1 and means to normally space the first leg of the key from the second leg.

4. The locking device of claim 3 wherein the means to space comprises a web, the web interconnecting the first and second legs.

5. The locking device of claim 4 wherein the spacing between the first and second legs can be temporarily reduced by squeezing the legs together.

* * * * *